United States Patent [19]

Ibberson

[11] 4,296,154

[45] Oct. 20, 1981

[54] STRIP BRICK FACING MATERIAL

[76] Inventor: Robert B. Ibberson, Gingerbread Hill, Arlington, Vt. 05250

[21] Appl. No.: 120,004

[22] Filed: Feb. 8, 1980

[51] Int. Cl.[3] ..... B44F 9/04

[52] U.S. Cl. ..... 428/15; 40/428; 46/12; 46/19; 52/314

[58] Field of Search ..... 428/43, 15; 46/1 R, 46/12, 14, 19; 52/314; 427/276; 40/428

[56] References Cited

U.S. PATENT DOCUMENTS

| | | | |
|---|---|---|---|
| 1,531,789 | 3/1925 | Jennings et al. | 427/276 |
| 2,137,896 | 11/1938 | Marsh | 52/314 |
| 2,219,507 | 10/1940 | Apgar et al. | 46/12 |
| 2,847,721 | 8/1958 | Diamond | 52/314 |
| 2,849,759 | 9/1958 | Burdette | 52/586 X |

*Primary Examiner*—Henry F. Epstein
*Attorney, Agent, or Firm*—Brumbaugh, Graves, Donohue & Raymond

[57] ABSTRACT

A simulated-brick facing material, and a process for its manufacture; the facing material being applied to imitation fireplaces; the process including a wooden panel being furrowed on one side with parallel rows of grooves in two right angle directions so as to form a plurality of brick-shaped faces, the panel then being slitted fully through along the longitudinal grooves so as to form strips which are then glued in offset positions on an imitation fireplace and thereafter are painted so to simulate brick material.

3 Claims, 10 Drawing Figures

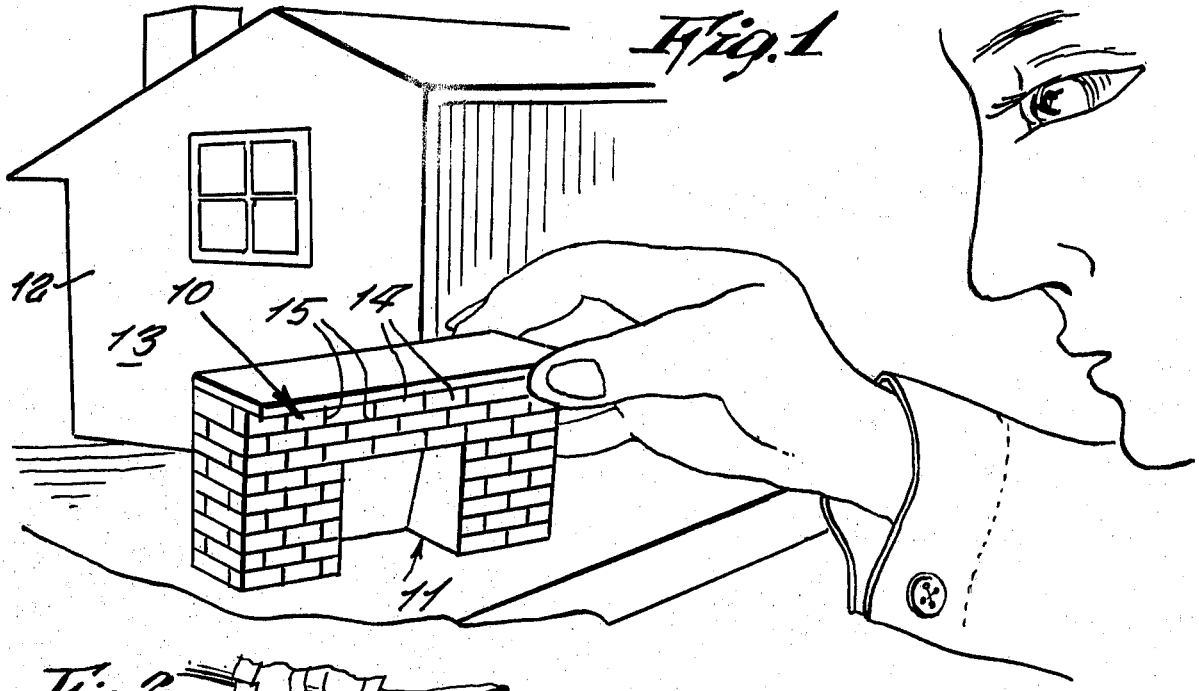
Fig.1
12
13
10
15
14
11
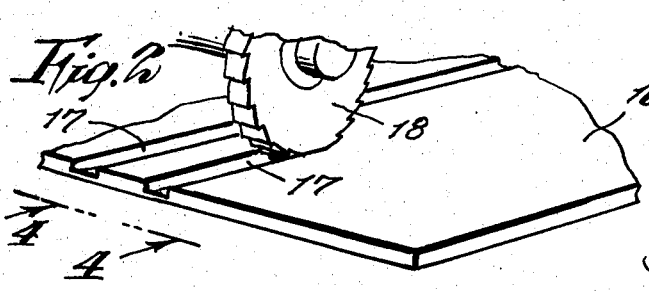
Fig.2
17
18
16
17
4
4
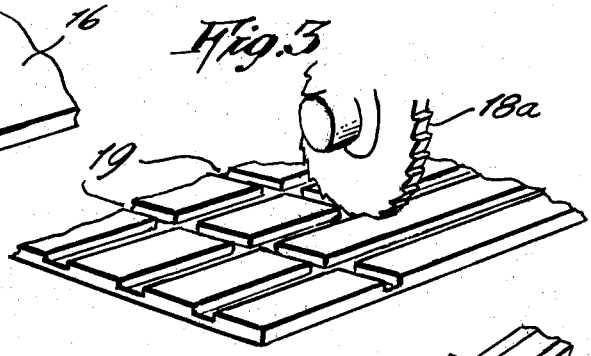
Fig.3
18a
19
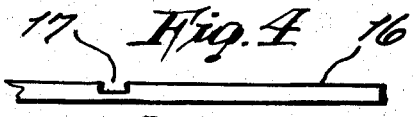
17
Fig.4
16
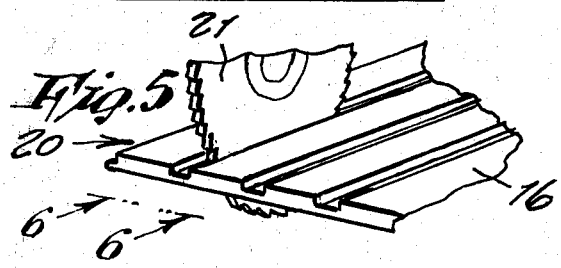
21
Fig.5
20
16
6
6
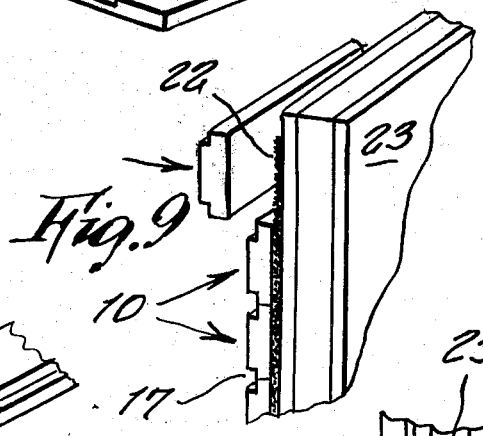
22
23
Fig.9
10
17
17
Fig.6
17
21
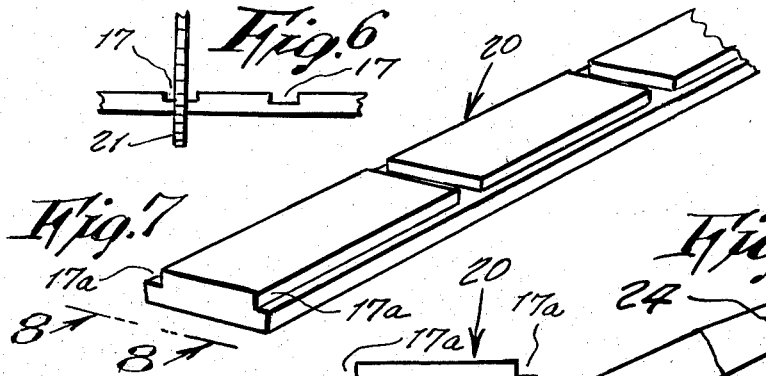
20
Fig.7
17a
17a
8
8
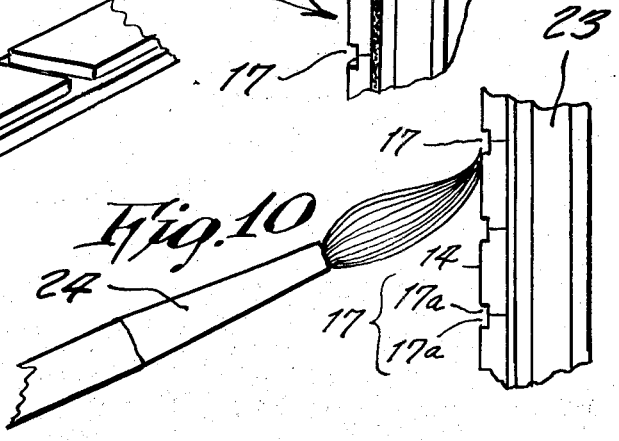
23
17
Fig.10
24
14
17
17a
17a
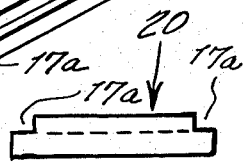
20
17a
17a
Fig.8

STRIP BRICK FACING MATERIAL

BACKGROUND OF THE INVENTION

This invention relates generally to imitation fireplaces and or bricks.

It is well known that a fireplace in a home gives a cozy appearance in a room, but many homes do not have a chimney provided for the same, so that persons in such homes wishing to have a fireplace, can install an imitation fireplace therein instead. It is accordingly desirable that such fireplace is realistic to an observer so as to produce a proper effect, including the appearance of being made of brick. Heretofore such brick effect has been made either by painting an outline of bricks thereupon or else applying small, individual, brick shaped, flat panels in off set rows so to imitate rows of bricks laid one upon another. This is a time-consuming work and is therefore in need of an improvement.

SUMMARY OF THE INVENTION

Accordingly it is a principal object of the present invention to provide a novel brick-facing for an imitation fireplace and the like which is realistic in appearance and which can be more easily and quickly applied during the imitation fireplace manufacture.

Another object is to provide a simulated-brick facing which can be made in any size so that it can be applied to small doll-house fireplaces as well as to full-sized imitation fireplaces used in persons' homes.

Still a further object is to provide a simulated-brick facing which can be also used as a facing for external and interior walls of actual homes, or of small doll house, as well as chimneys of doll houses.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a perspective view of an object, such as a fireplace or the like and which is made with the strip brick facing material of the present invention.

FIGS. 2 through 10 shows successive steps in the manufacture of the strip brick facing material surfaced panelling used to make a minature object such as a brick wall for a fireplace, a doll house wall, or the like.

DETAILED DESCRIPTION OF THE PREFERRED EMBODIMENT

Referring now to the drawing in greater detail, the reference numeral 10 represents a simulated-brick facing according to the present invention, and which in FIG. 1 is shown having been made on a small scale and applied to a miniature fireplace 11 for being installed inside a tiny doll-house 12. The facing 10 can likewise be applied also to walls 13 of the doll-house, if so preferred by the doll-house manufacturer. The facing 10 is made realistic in appearance so as to resemble actual brick, by having each brick face 14 raised from the line of morter 15 that is between the brick faces. The brick faces of each adjacent row of bricks are off set one upon another so as to resemble an actual laid brick structure. Additionally the surfaces of the morter and brick face are painted realistically, in colors.

The facing 10 is manufactured in a process wherein a flat wooden panel 16 is first furrowed by parallel rows of grooves 17 in one direction by means of cutters 18, and thereafter the panel is turned at right angle so that narrower cutters **18*a* then cut the parallel grooves 19, so that the panel face is divided into the brick shaped, brick faces 14 while the indented grooves form the recessed surface of the morter 15** therebetween.

Thereafter the panel 16 is cut up into longitudinal strips 20 by means of still more thin cutters 21 cutting completely through the panel along a center of each groove 17 that forms a longitudinal upper and lower edges of each brick face.

As clearly shown in the drawing the grooves 17 are wider than the grooves 19, so that the portion of groove 17 cut away subsequently by the cutter 21, results in the grooves 17 finally resulted in the facing 10 being equal in width to the grooves 19.

Thus the strips cut by the cutters 21 results in a one-half groove **17*a*** along each longitudinal side of the strip.

The strips are then glued by means of adhesive 22 to an outer side of the fireplace body 23; each adjacent strip being offset one-half brick away from brick faces in the row therebelow. After all protruding ends of the strips are cut off and the side edges of the assembled strips are sanded, the front surface of the grooves and the brick faces are suitably painted by brushes 24.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A simulated brick facing for application to a supporting member including individual strips, each simulating a layer of brick, at least one longitudinal groove along at least one side of each strip simulating the horizontal, recessed mortar layer between layers of brick, transverse grooves simulating vertical, recessed mortar bonds between side-by-side bricks, said grooves defining raised lands simulating the visible faces of individual bricks, side walls of both said longitudinal and transverse grooves being entirely substantially perpendicular to the lands and the groove bottoms and being entirely free of any undercuts therein into the body of the simulated bricks, said individual strips having planar undersurfaces adapted to be applied one above the other to the supporting member to represent a brick structure.

2. Simulated brick facing for miniature houses and the like including individual strips substantially less than one half inch wide, at least one longitudinal groove along at least one side of each strip simulating the horizontal, recessed mortar layer between layers of bricks, transverse grooves simulating vertical, recessed mortar bonds between side-by-side bricks, said grooves defining raised lands simulating tiny individual bricks, side walls of both said longitudinal and transverse grooves substantially perpendicular to the faces of said lands and being entirely free of any undercuts therein into the body of the simulated bricks, said individual strips having planar undersurfaces adapted to being applied one above the other to a supporting member to represent a miniature brick structure.

3. Simulated brick according to claim 2 wherein each strip simulates a layer that is one brick wide, each strip has a thickness less than approximately one half the width of the strip, and each groove has a depth from approximately one half to one quarter the thickness, the longitudinal grooves extend along each side of the strips, each defining half of the simulated horizontal, recessed morter layer, all of said grooves having planar walls extending perpendicularly entirely from the lands to the groove bottoms.

* * * * *